US011064780B1

(12) United States Patent
Doros

(10) Patent No.: US 11,064,780 B1
(45) Date of Patent: Jul. 20, 2021

(54) HAIR BOW WITH INTEGRAL RECLOSABLE COMPARTMENT

(71) Applicant: SACAMANO, LLC, Southlake, TX (US)

(72) Inventor: Evelyn Grace Doros, Southlake, TX (US)

( * ) Notice: Subject to any disclaimer, the term of this patent is extended or adjusted under 35 U.S.C. 154(b) by 0 days.

(21) Appl. No.: 17/087,399

(22) Filed: Nov. 2, 2020

Related U.S. Application Data

(60) Provisional application No. 63/089,401, filed on Oct. 8, 2020.

(51) Int. Cl.
*A45D 8/00* (2006.01)

(52) U.S. Cl.
CPC ..... *A45D 8/00* (2013.01); *A45D 8/002* (2021.01)

(58) Field of Classification Search
CPC ..... A45D 8/00; A45D 8/32; A45D 2008/002; A45D 2008/004; A45D 2008/006; A45D 2/00; A45D 2/14; A45D 2/143; A45D 2/148; A45D 2/2428; A45D 2/28; A45D 2002/007
USPC ..... D28/39, 41; D3/215; 132/273, 274, 275
See application file for complete search history.

(56) References Cited

U.S. PATENT DOCUMENTS

| | | | | |
|---|---|---|---|---|
| D356,887 | S * | 4/1995 | Revson | D28/41 |
| 5,732,720 | A * | 3/1998 | Sears | A45D 8/00 132/128 |
| 2008/0072922 | A1* | 3/2008 | Shidler | A45D 8/34 132/275 |
| 2015/0050433 | A1* | 2/2015 | Murray | D04D 7/10 428/5 |
| 2015/0075554 | A1* | 3/2015 | Faust | A45D 8/24 132/277 |
| 2017/0127786 | A1* | 5/2017 | Costanz | A45D 8/36 |

* cited by examiner

*Primary Examiner* — Rachel R Steitz
*Assistant Examiner* — Karim Asqiriba
(74) *Attorney, Agent, or Firm* — James R. Gourley; Carstens & Cahoon, LLP

(57) ABSTRACT

A hair bow with at least one integral reclosable compartment is disclosed. The hair bow can include two or more wings, with one or more wing being a reclosable compartment. The compartment can be opened and closed by use of a zipper, a button, a snap, a tongue-in-groove closure, or other reclosure mechanism.

6 Claims, 3 Drawing Sheets

HAIR BOW WITH INTEGRAL RECLOSABLE COMPARTMENT

CROSS REFERENCE TO RELATED APPLICATION

This application claims the benefit of provisional U.S. Application No. 63/089,401 entitled "Hair Bow with Integral Reclosable Compartment" filed Oct. 8, 2020, the entirety of which is incorporated herein in its entirety.

BACKGROUND OF THE INVENTION

Technical Field

The present invention relates to an apparatus that attaches to a lock of hair and includes at least one reclosable compartment.

SUMMARY OF THE INVENTION

In one embodiment, a hair tie comprises: a hair fastening member attached to a hair bow, wherein the hair bow comprises at least two wings extending from a center, wherein at least one of the at least two wings of the hair bow is a reclosable compartment. In another embodiment, the hair fastening member is an elastic band or a hair clip. In another embodiment, the reclosable compartment comprises a button, a series of buttons, a snap, a series of snaps, a sliding closure, a tongue-in-groove closure having interlocking mechanical profiles, or a peelable adhesive reclosure. In another embodiment, the reclosable compartment comprises two panels of hair bow wing fabric fixedly joined along at least one edge and reclosably joined along another edge. In another embodiment, the hair bow is attached to the hair fastening member at the center of the hair bow. In another embodiment, two of the at least two wings of the hair bow are reclosable compartments. In another embodiment, the reclosable compartment is bounded at a top edge by a reclosure mechanism. In another embodiment, the reclosable compartment is bounded at a bottom edge by a reclosure mechanism. In another embodiment, the reclosable compartment extends outward from the center of the hair bow.

In one embodiment, a hair tie comprises: a ribbon hair bow comprising a first wing and a second wing, wherein the first wing and the second wing are on opposite sides of a center of the hair bow, wherein the hair bow is attached to a hair fastener at the center of the hair bow, further wherein the first wing of the hair bow is a reclosable compartment with a zipper closure at a bottom edge of the first wing of the hair bow.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

The present invention relates to a hair tie comprising a hair bow that includes an integral reclosable compartment in at least one of the bow wings. As used herein, a reclosable compartment is a compartment that may be selectively opened and closed by operation of a reclosure member, such as a zipper.

Figure 1:
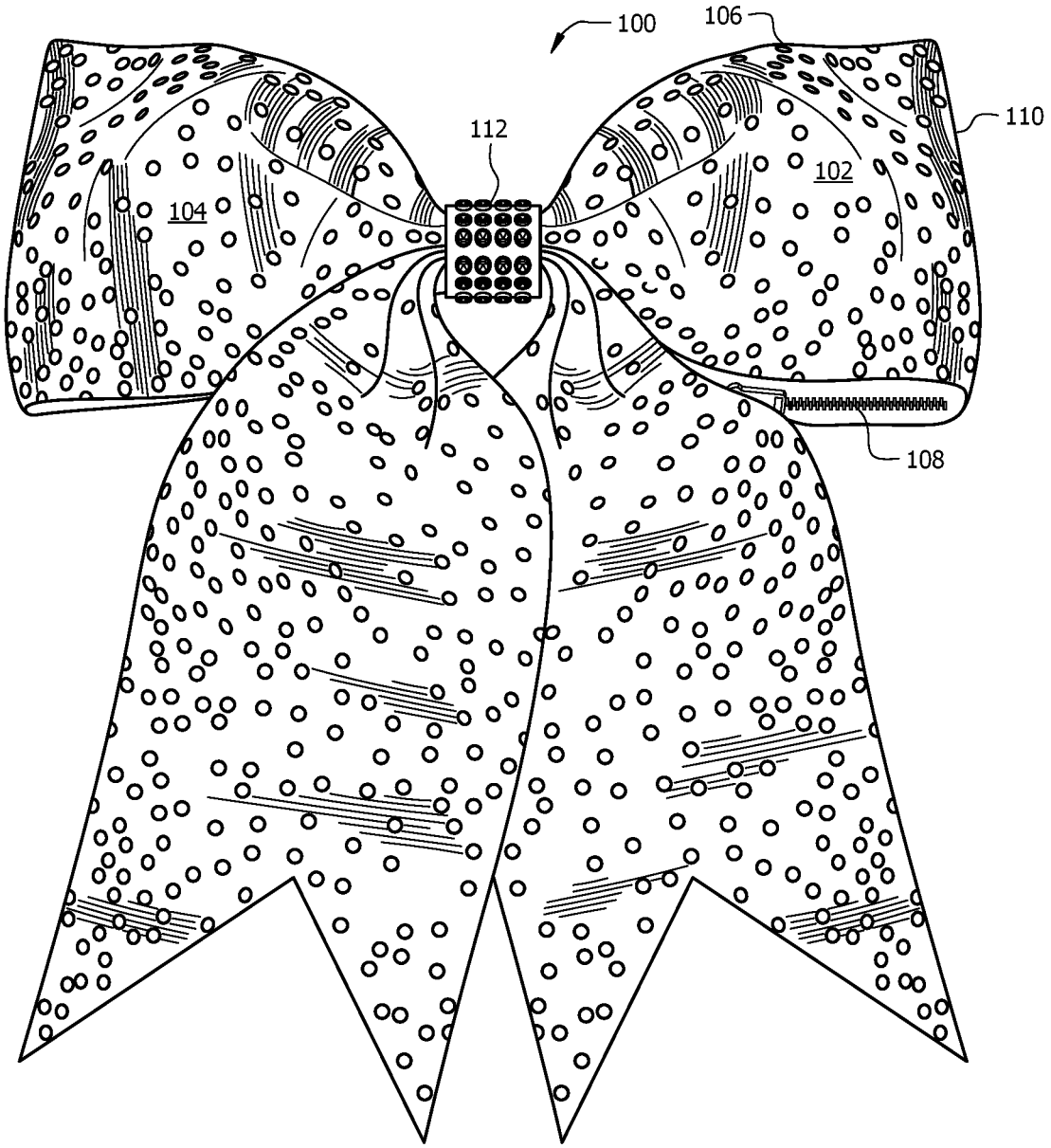
FIG. 1 is a top perspective view of one embodiment of the present invention.

FIG. 1 depicts one embodiment of a hair tie 100 of the present invention. In the embodiment depicted in FIG. 1, the hair tie 100 comprises a hair bow having a first wing 102 and a second wing 104 on opposite sides of a central portion or center 112. First wing 102 comprises a reclosable compartment between first edge 106, second edge 110, and reclosure member 108. The reclosable compartment shown in FIG. 1 is formed from walls bounded by folded edge 110 between the fabric panels that form first wing 102, closed edge 106, and reclosure member or mechanism 108.

As depicted in FIG. 1, reclosure member 108 may be a zipper closure (a series of interlocking metal or plastic teeth that may be engaged or disengaged from one another by pulling a tab attached to a slide body actuator) in one embodiment. Typically, the zipper teeth on either side of the slide will be attached to a tape strip. The tape strips can be sewn or adhered to the fabric material used to make the bow to create one edge of the reclosable compartment described herein. In other embodiments, the reclosure member or mechanism 108 may be a button or series of buttons, a snap or series of snaps, a sliding closure, a tongue-in-groove closure having interlocking mechanical profiles, or a peelable adhesive reclosure. A zipper is preferable to other types of closures because it seals the entire length of the edge of the hair bow wing more securely than other types fasteners yet it is easy to open and close when needed. In this way, at least one wing of the hair bow is formed into a reclosable compartment.

In the embodiment depicted in FIG. 1, second wing 104 of the hair bow does not comprise a reclosable compartment but is visually similar to first wing 102. However, other embodiments may include a second reclosable compartment as a part of second wing 104. The structure and closure mechanism of the second reclosable compartment may be the same as or different from the reclosable compartment of the first wing 102. Additionally, the hair bow depicted in FIG. 1 has two wings, but other embodiments are possible utilizing hair bows with more than two wings, for example, three wings or four wings.

In the embodiment in FIG. 1, the reclosable compartment is formed by sewing together the two fabric panels used to make the first wing 102 of the hair bow, thereby fixedly joining the fabric panels together along the first edge 106, and attaching a reclosure member, such as a zipper, along the opposite edge at 108. However, alternative constructions are also possible. For example, a reclosure member could be attached at both locations 106 and 108 to provide a reclosable compartment accessible from the top or bottom edge of the first wing 102 of the hair bow. Alternatively, a single reclosure member could seal along all of the edges of the compartment from 108 to 110 to 106.

Figure 2:
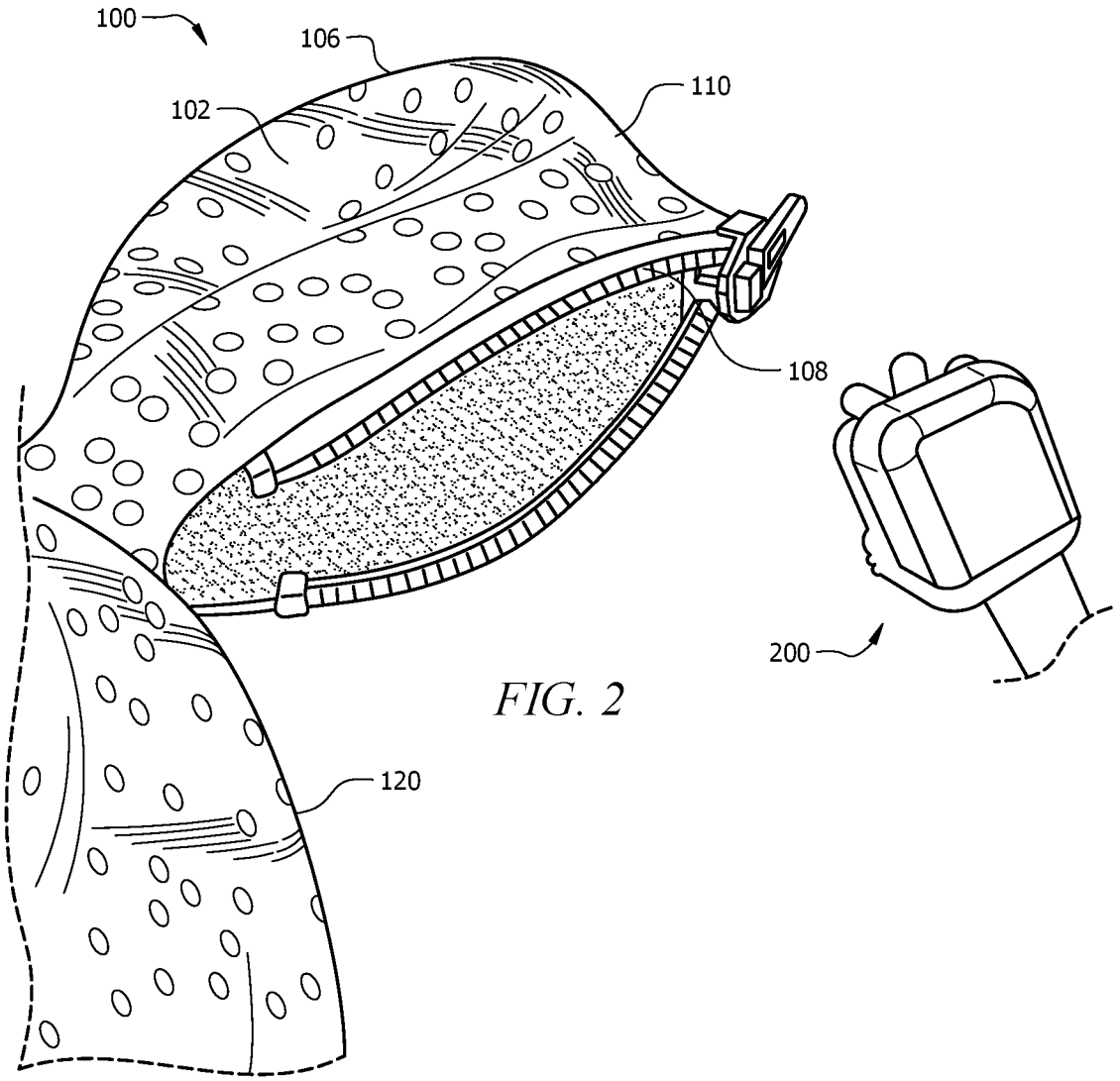
FIG. 2 is a zoomed in perspective view of one embodiment of the present invention with the compartment in open configuration.

FIG. 2 depicts a zoomed in perspective view of the hair tie 100 first wing 102 reclosable compartment in open configuration. The reclosable compartment is in open configuration because the teeth on opposite sides of the zipper closure at 108 have been disengaged from each other by moving the zipper slide from one end of the zipper closure to the other. When in open position, a user may place an item, such as toy 200 depicted in FIG. 1, into the reclosable compartment. Toy 200 may then be held within the reclosable compartment of first wing 102 by moving the zipper slide back towards the center of the hair bow, thereby reengaging the teeth on opposite sides of the zipper closure with one another to reclose the compartment.

Figure 3:
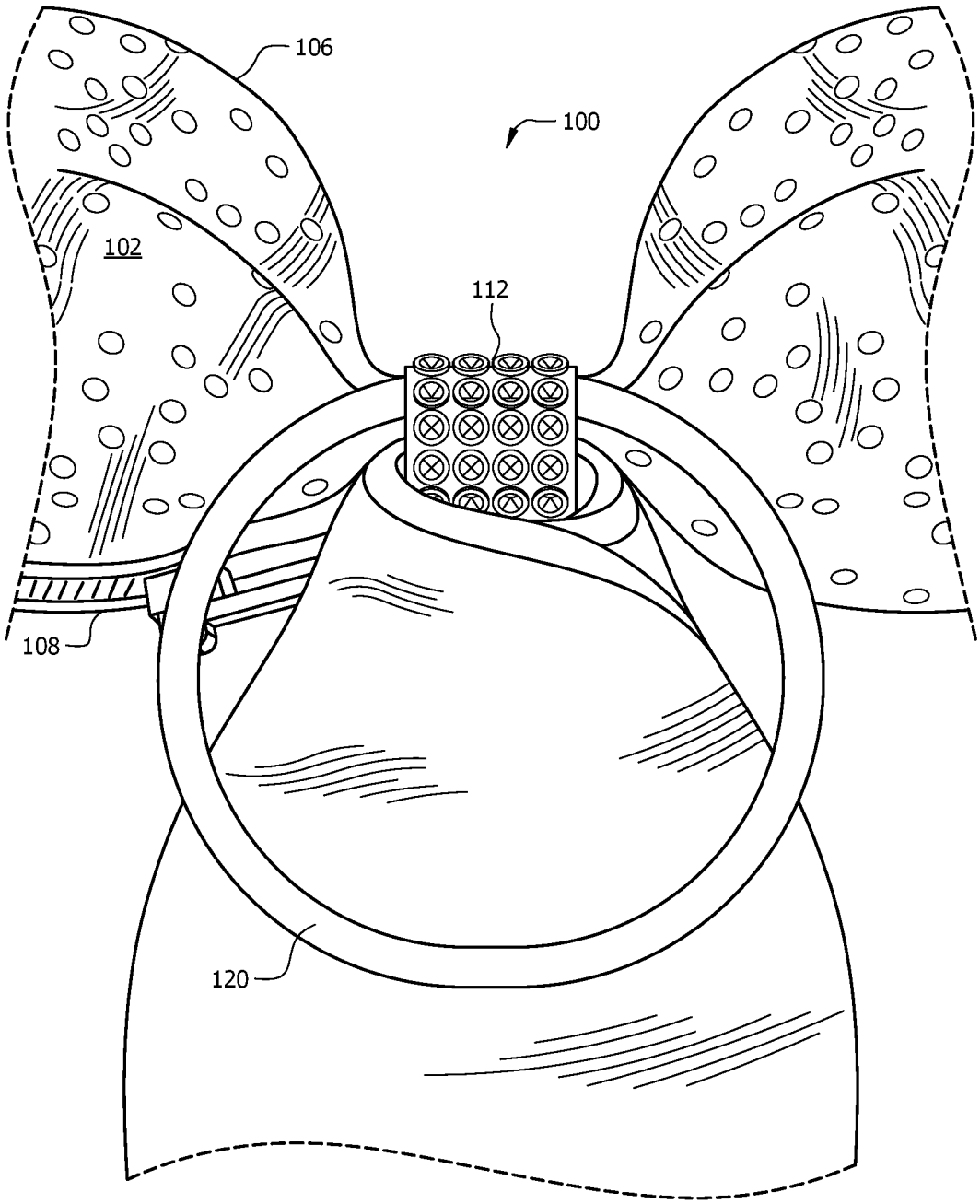
FIG. 3 is a zoomed in perspective view of the opposite side of the embodiment shown in FIG. 1.

FIG. 3 depicts the hair tie 100 embodiment of FIG. 1 from the opposite side. FIG. 3 depicts an example of a hair fastener as elastic band 120. The hair fastener in FIG. 3 is attached to the hair bow 100 at the center 112 of the hair bow 100.

A practitioner may manufacture the embodiment of the inventive hair bow shown in the enclosed figures using the following example procedure, although other manufacturing techniques may be used. First, a long, narrow section of fabric or ribbon is tied into a bow by tying two loops of ribbon or fabric together and spreading the loops flat to form the first and second wings. Sections of the ribbon that do not form the loops or wings of the bow will instead form the tails that hang down from the central portion of the bow. With reference to FIG. 1, after the bow is first formed, first wing 102 will comprise folded ribbon at edge 110, and will be open at edges 106 and 108. Next, one edge (106 or 108) may be closed by sewing the pieces of ribbon that form the bow wing together at that edge using, for example, a needle and thread. In this embodiment, the two panels of fabric that form the first wing 102 of the hair bow would be fixedly joined at edges 106 and 110. Finally, the other edge (106 or 108) may be reclosably joined along another edge by attaching a reclosure member that is reclosable, for example, a zipper closure. Each side of the zipper closure can be aligned with each side of the ribbon or fabric at the edge being closed, and the zipper closure sewn into the bow with the pull tab facing out. Other manufacturing methods may also be used.

In a preferred embodiment, the bow is made of ribbon or decorative fabric, but almost any generally flexible sheet-like material, such as a textile, a plastic sheet, or a rubber sheet, may be used. In another preferred embodiment, the reclosure mechanism is "hidden" by attaching the reclosure mechanism deep enough into first wing 102 such that the bow fabric at least partially conceals the presence of the reclosure mechanism. Further, the reclosure mechanism is depicted in FIG. 1 as a zipper closure 108 on the bottom edge, but the reclosure mechanism may instead be placed on the top edge 106, or on both the top edge and bottom edge.

In a preferred embodiment, the hair fastener element is an elastic band 120, as depicted in FIG. 1, but in other embodiments the hair fastener can be a barrette, a hair clip, a hair pin, a clasp, a butterfly clip, a snap clip, an alligator clip, or any combination thereof. The hair tie of the present invention may also include more than one type of hair fastener.

It will now be evident to those skilled in the art that there has been described herein a hair tie comprising a hair bow with integral reclosable compartment on at least one wing of the hair bow. Although the invention hereof has been described by way of preferred embodiments, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention.

In sum, while this invention has been particularly shown and described with reference to a preferred embodiment, it will be understood by those skilled in the art that various changes, in form and detail may be made therein without departing from the spirit and scope of the invention.

What is claimed is:

1. A hair tie consisting of:

a hair fastening member attached to a hair bow, wherein the hair bow consists of two wings extending from a center, wherein one of the two wings of the hair bow is a reclosable compartment, wherein the wings are formed from a single section of fabric or ribbon formed into two loops and tied at the center, wherein the reclosable compartment consists of two panels of the hair bow wing fabric or ribbon, one outer folded loop edge opposite the center of the hair bow, one fixedly joined loop edge extending from the center of the hair bow toward a first end of the outer folded loop edge, and one reclosably joined loop edge opposite the fixedly joined loop edge, wherein the reclosably joined loop edge comprises a zipper closure mechanism extending from the center of the hair bow toward a second end of the outer folded loop edge of the reclosable compartment.

2. The hair tie of claim 1, wherein the hair fastening member is an elastic band or a hair clip.

3. The hair tie of claim 1, wherein the hair bow is attached to the hair fastening member at the center of the hair bow.

4. The hair tie of claim 1, wherein the reclosable compartment is bounded at a top edge extending from the center of the hair bow by the zipper closure mechanism.

5. The hair tie of claim 1, wherein the reclosable compartment is bounded at a bottom edge extending from the center of the hair bow by the zipper closure mechanism.

6. The hair tie of claim 1, wherein the reclosable compartment extends outward from the center of the hair bow and is accessible from a top edge extending from the center of the hair bow or a bottom edge extending from the center of the hair bow.

* * * * *